US008210882B2

(12) United States Patent
Tomás Gilabert et al.

(10) Patent No.: US 8,210,882 B2
(45) Date of Patent: Jul. 3, 2012

(54) MODULAR CONNECTOR FOR ELECTRIC CONNECTIONS

(75) Inventors: Joaquin Tomás Gilabert, Beniarres (ES); Juan Carlos Tomás Gilabert, Beniarres (ES)

(73) Assignee: Daisel Innova, S.L., Beniarres, Alicante (ES)

( * ) Notice: Subject to any disclaimer, the term of this patent is extended or adjusted under 35 U.S.C. 154(b) by 0 days.

(21) Appl. No.: 12/674,274

(22) PCT Filed: Jul. 24, 2008

(86) PCT No.: PCT/ES2008/070145

§ 371 (c)(1),
(2), (4) Date: Sep. 19, 2011

(87) PCT Pub. No.: WO2009/024633

PCT Pub. Date: Feb. 26, 2009

(65) Prior Publication Data

US 2012/0003878 A1 Jan. 5, 2012

(30) Foreign Application Priority Data

Aug. 21, 2007 (ES) ..... 200702312

(51) Int. Cl.
*H01R 9/22* (2006.01)

(52) U.S. Cl. ..... 439/709

(58) Field of Classification Search ..... 439/709, 439/712, 811, 812
See application file for complete search history.

(56) References Cited

U.S. PATENT DOCUMENTS

| | | | | |
|---|---|---|---|---|
| 4,469,393 | A | 9/1984 | Chewning, Jr. et al. | |
| 2002/0076991 | A1 * | 6/2002 | Conde et al. | 439/709 |
| 2005/0130508 | A1 * | 6/2005 | Yeh | 439/709 |
| 2007/0293096 | A1 * | 12/2007 | Hackemack et al. | 439/709 |
| 2008/0153361 | A1 * | 6/2008 | Hein | 439/709 |
| 2011/0086555 | A1 * | 4/2011 | Hertzler et al. | 439/712 |
| 2011/0294363 | A1 * | 12/2011 | Yeh | 439/709 |

FOREIGN PATENT DOCUMENTS

| | | |
|---|---|---|
| EP | 0 817 318 | 1/1998 |
| ES | 1 029 508 | 5/1995 |
| GB | 2 295 731 | 6/1996 |

* cited by examiner

*Primary Examiner* — Tulsidas C Patel
*Assistant Examiner* — Phuongchi Nguyen
(74) *Attorney, Agent, or Firm* — Merchant & Gould P.C.

(57) ABSTRACT

Modular connector for electrical connections, provided with an external anchoring system which facilitates the grouping and fixing of several connectors through male and female couplings, both laterally and transversally. For first-sight recognition, the wraparound insulating carcasses (4) are standard color-keyed to identify the conductors. For the recognition of each circuit it is provided with an upper cover (6) which can be signaled by the user. The conductor part has a set of one or more metallic parts always of the same pole (1), and the set is built into a wraparound insulating carcass (5), having the same color as the conductor cable for this element.

8 Claims, 7 Drawing Sheets

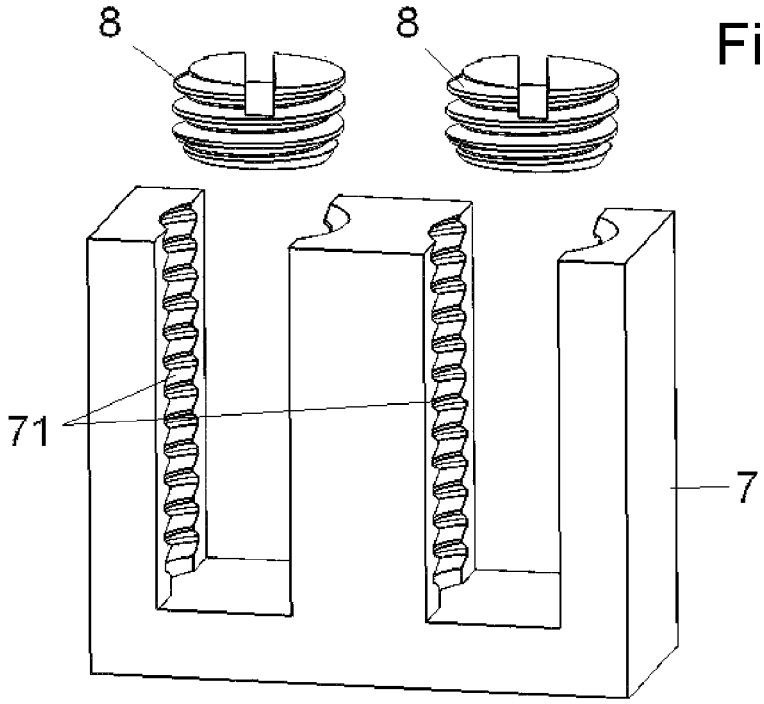
Fig. 5
Fig. 6
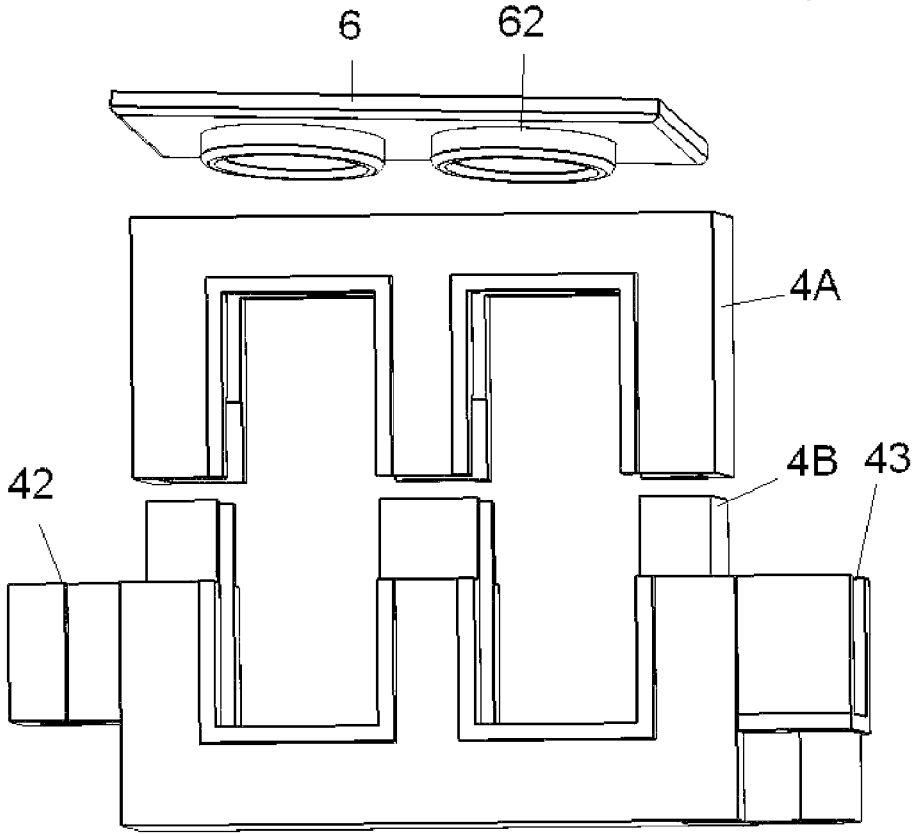

MODULAR CONNECTOR FOR ELECTRIC CONNECTIONS

This application is a National Stage Application of PCT/ES2008/070145, filed 24 Jul. 2008, which claims benefit of Serial No. P200702312, filed 21 Aug. 2007 in Spain and which application(s) are incorporated herein by reference. To the extent appropriate, a claim of priority is made to each of the above disclosed applications.

OBJECT OF THE INVENTION

This invention relates to the connection and identification of electrical conductors and circuits and more particularly to the electric cable connections in facilities for the distribution and control of electric power.

BACKGROUND OF THE INVENTION

The existing terminal blocks are often manufactured and commercialized as terminal strips or blocks (normally from 10 to 12 elements per strip), which are separated according to the mounting needs and do not have any conductor signalization or identification means. Generally, they have the following inconveniences, as regards:

a) Signalization: There exist no possibility of signaling circuits as there is no cover or possible coupling of the identification element, unless plastic marking washers or labels fixed or tied to the conductor cables are used. The washers have several inconveniences among which we can mention: a) the washers are needed for each set of numbers and/or letters needed for each cable: and b) these washers are not normally attached to the cable so they slide, turn or are lost when it is disconnected. On the other hand, the labels are a hindrance to the handling of cables.

b) Identification: There is no possibility of identifying the conductors by the connector colors as they are colorless elements.

c) Insulation: Some of the current elements lack enough protection as they do not have stops or enough insulation.

d) Cable fastening: Base for fixing the cables with a curved shape, decreasing, with respect to a flat shape, the degree of cable fastening since they are pressed by the screws on the base.

e) Interconnection: Nowadays, terminal blocks are used, which are only sectional without any possibility of interconnecting more elements or different elements.

On the other hand, the terminal blocks of the previous art normally have through holes which enable their fastening by means of screws or riveting to a base, but do not have mechanisms which allow its autonomous grouping without any need of fixing each individual piece to the base but fixing the whole set instead.

In order to solve these inconveniences it has been created the family of modular connectors of the present invention according to the attached claims.

DESCRIPTION OF THE INVENTION

The modular connectors for electric connections of the present invention have an external anchoring system which facilitates the grouping of components, through tongue and groove couplings which allow convenient constructions for each application.

For first-sight recognition, the wraparound insulating carcasses are color-keyed to identify the conductors: phase, neutral and safety ground. However, they can be died with the appropriate colors according to the different standards. To that same end, and for a more detailed knowledge of each circuit according to the circuit diagrams, they have an upper thermoplastic cover which can be signaled to the user.

The conductor part features a set of one or more metallic conductor parts, all of them being of the same pole and the set being enclosed in an insulating thermoplastic wraparound carcass, using the same color of the conductor cable for this element. Each metallic conductor part has a binding screw to fasten the cables housed in the inner hole of the metallic part and secure good electric contact as well. These metallic conductor parts are manufactured from a rectangular metallic bar of a conductor material perforated at its ends through folding or from a rectangular extrusion profile, or manufactured by casting.

DESCRIPTION OF THE DRAWINGS

FIG. 1 is a frontal view of the simple electrical connector;

FIG. 2 shows the upper cover, the screw and the inner metallic component;

FIG. 3 shows an upper view of the simple electrical connector; and

FIG. 4 shows a complete view of the simple electrical connector.

FIGS. 5 to 7 represent a double connector and show, respectively:

FIG. 5 shows an exploded view of the inner electrical connector;

FIG. 6 shows the external components of the electrical connector; and

FIG. 7 shows a complete view of the connector.

FIG. 8 shows the external components of the electrical connector;

FIG. 9 shows the screws and the inner metallic component; and

FIG. 10 shows a complete view of the connector.

FIG. 11 shows an exploded view of the electrical connector;

FIG. 12 shows an upper view of the electrical connector; and

FIG. 13 shows a complete view of the electrical connector mounted on the possible coupling.

PREFERRED EMBODIMENT OF THE INVENTION

Figure 1:
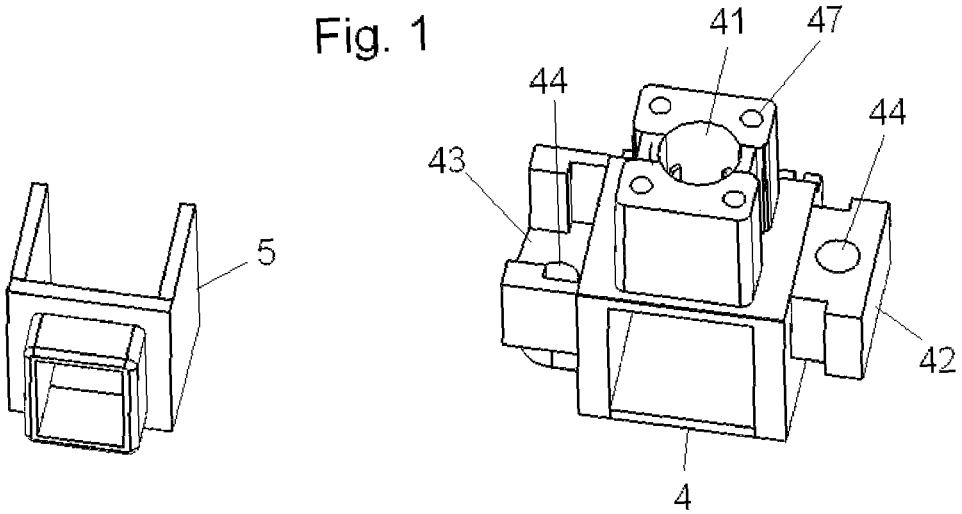
FIGS. 1 to 4 represent a simple connector or binding post and show, respectively.
Figure 2:
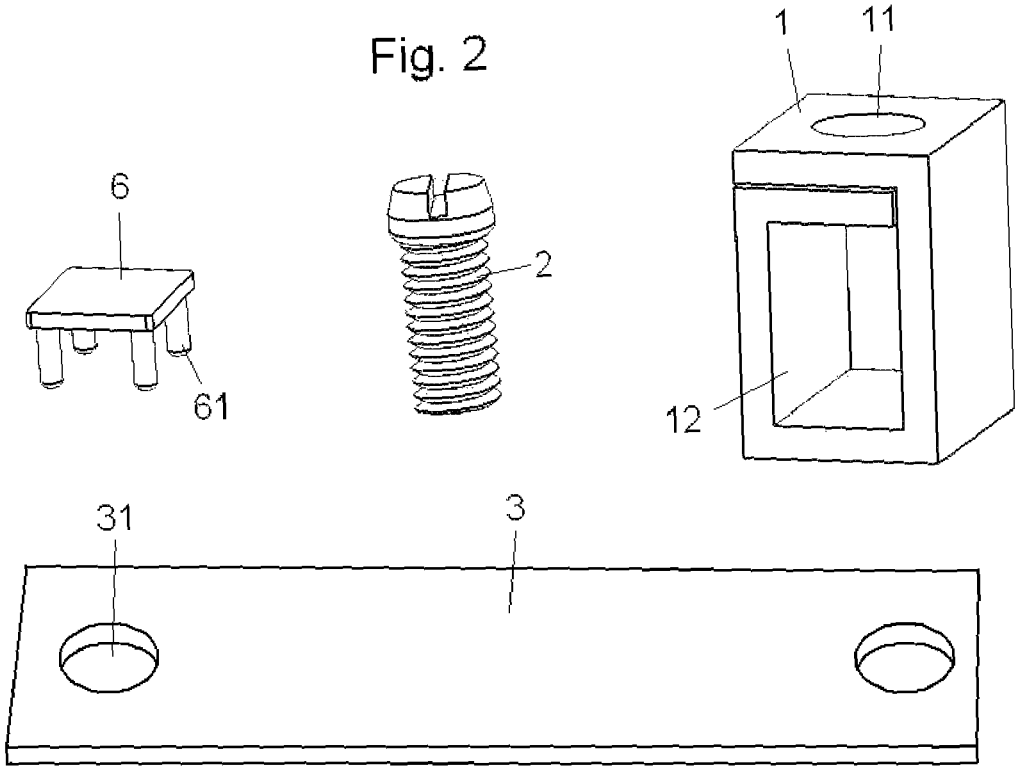
Figure 3:
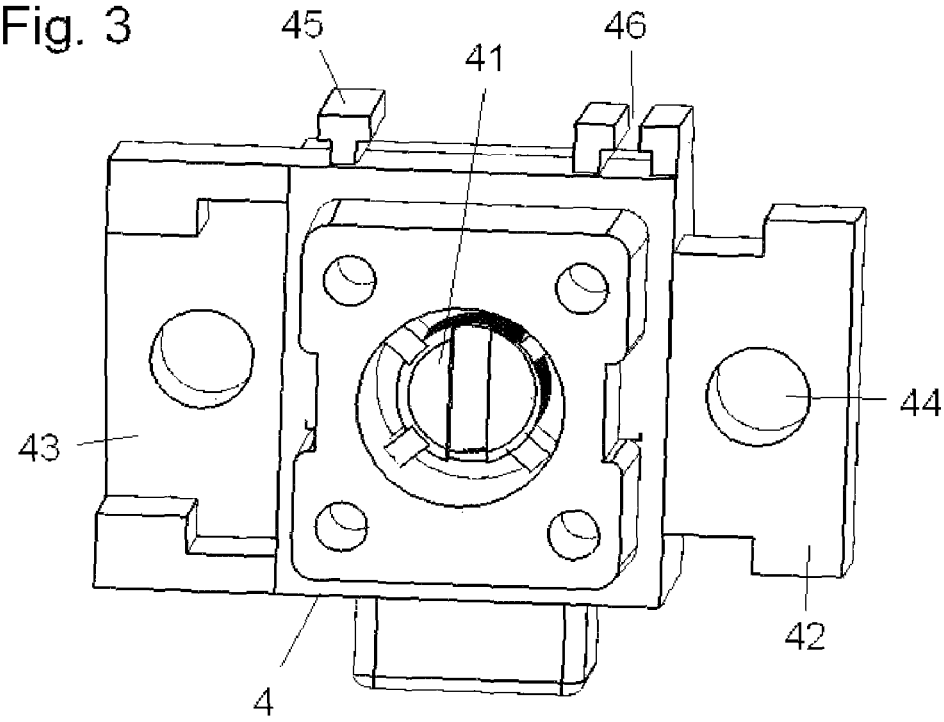
Figure 4:
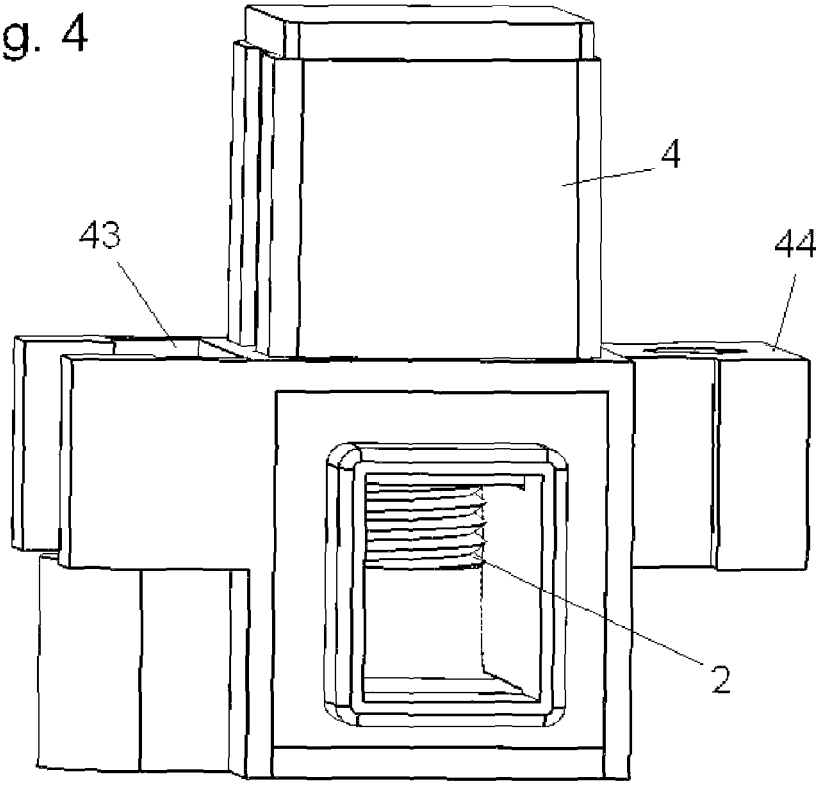
Figure 7:
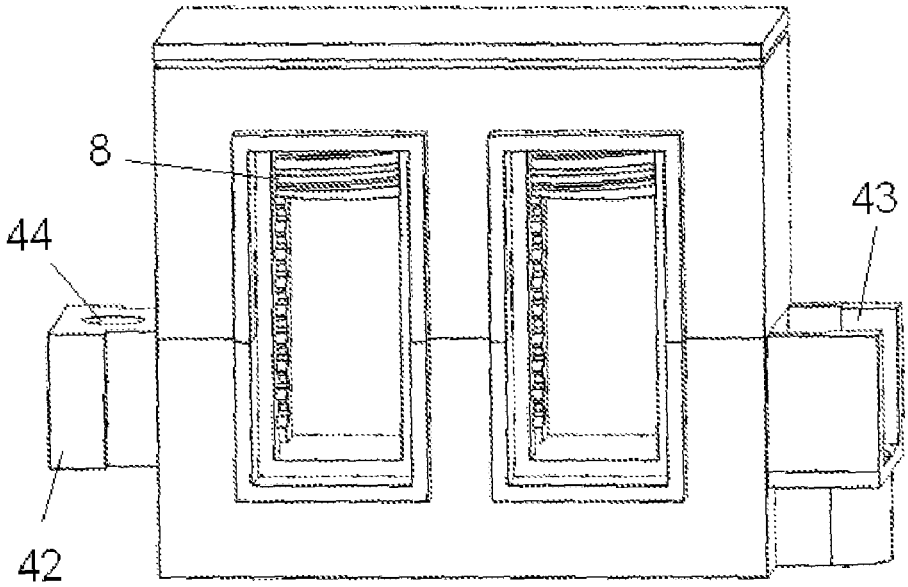
Figure 8:
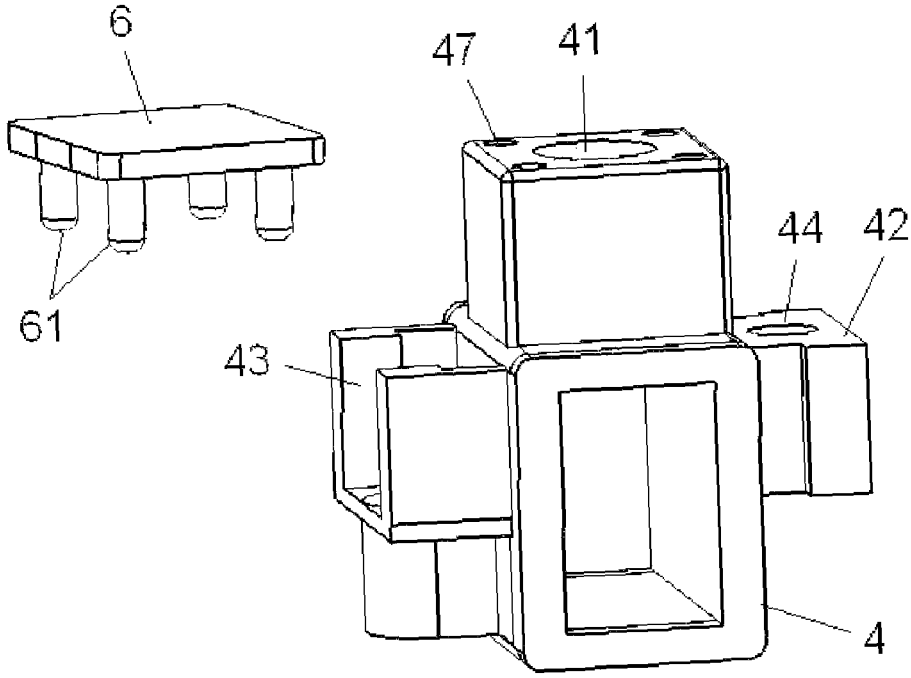
FIGS. 8 to 10 represent a through connector and show, respectively.
Figure 9:
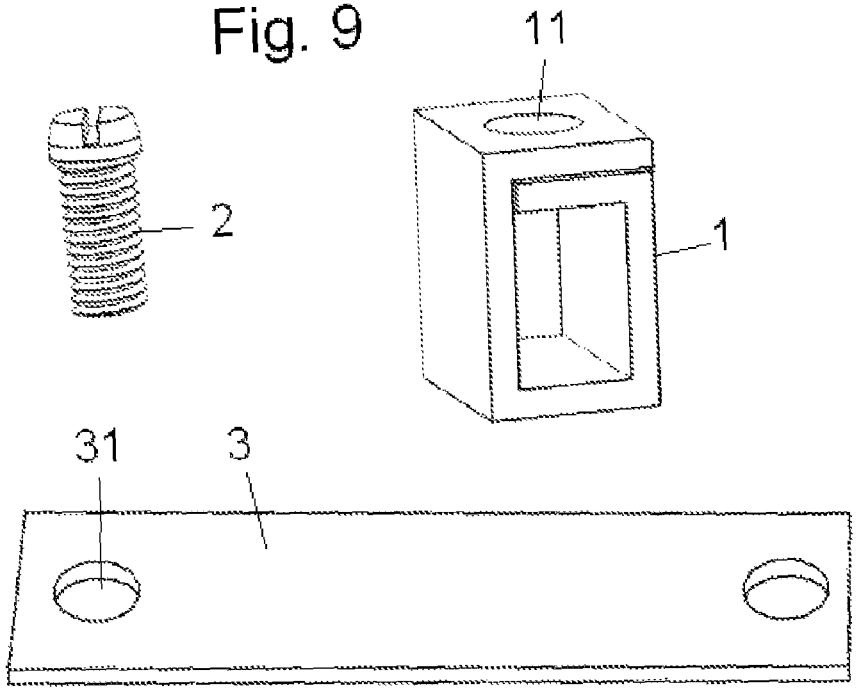
Figure 10:
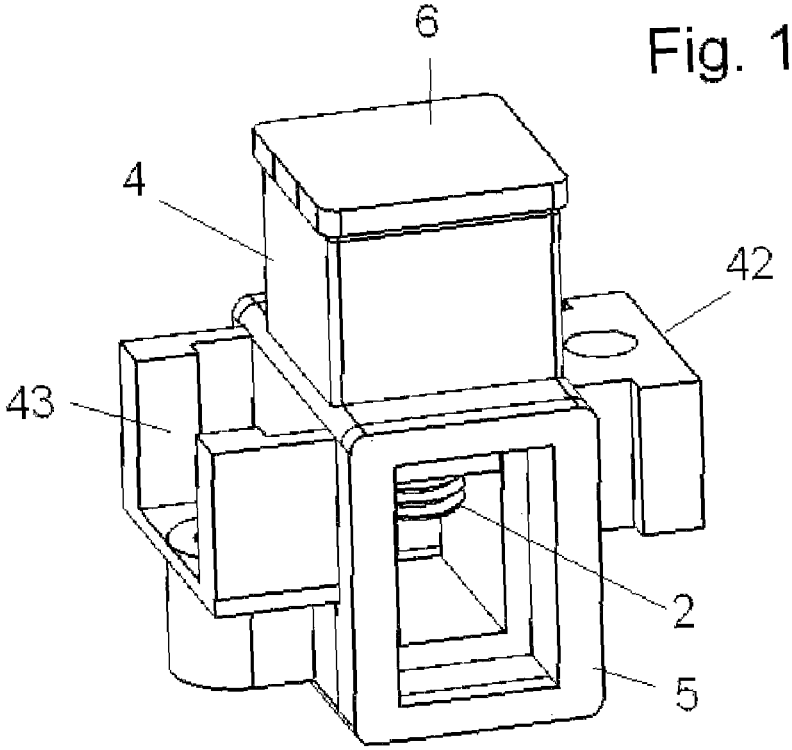
Figure 11:
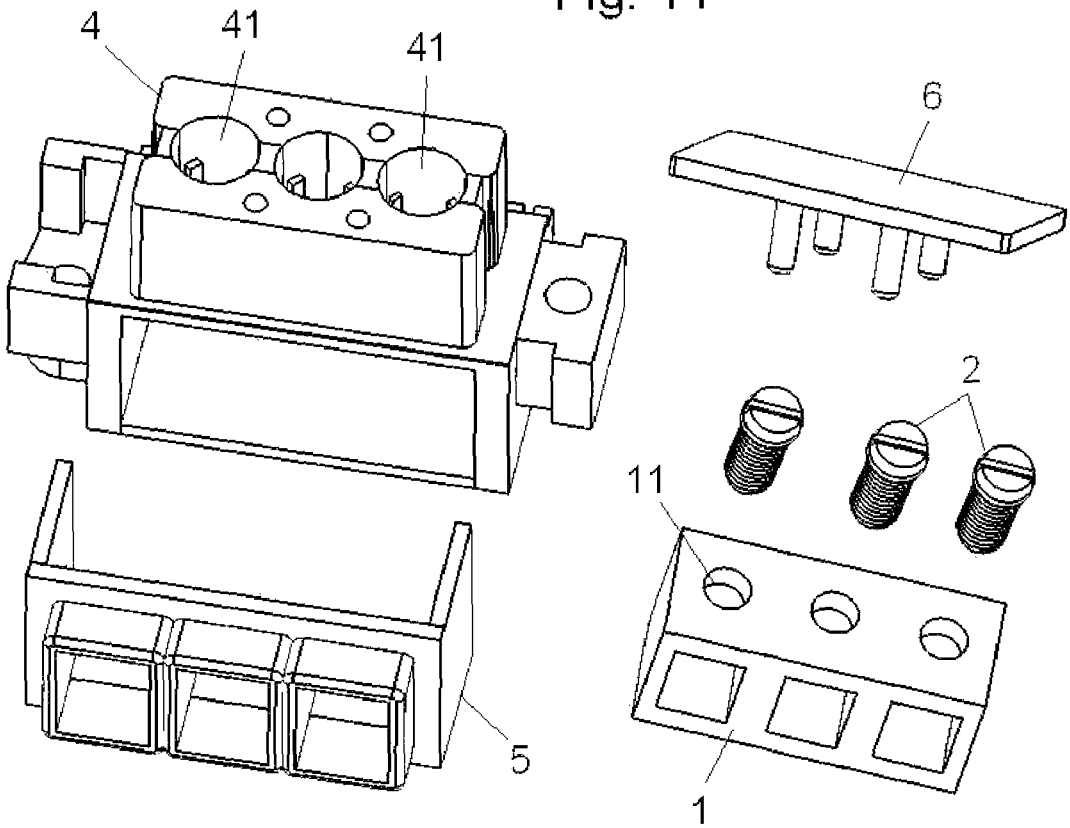
FIGS. 11 to 13 represent a triple connector and show, respectively.
Figure 12:
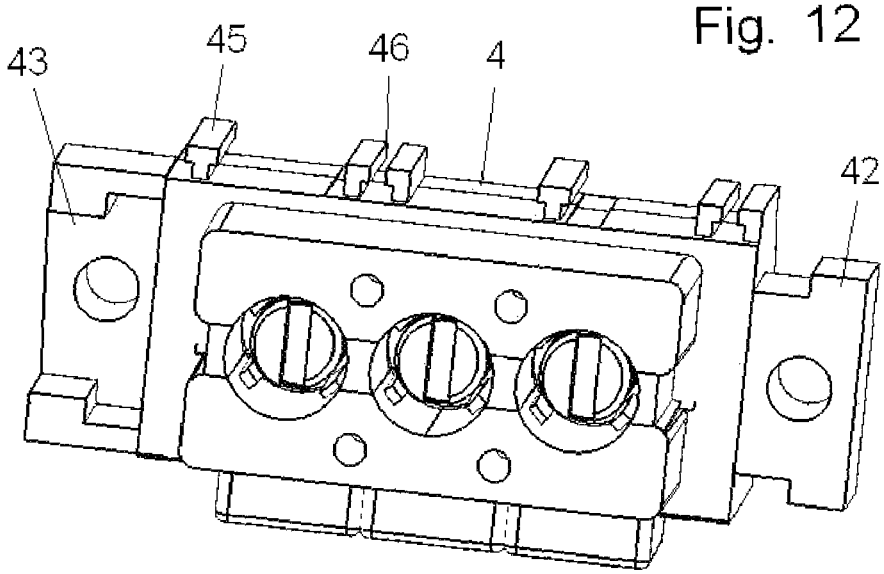
Figure 13:
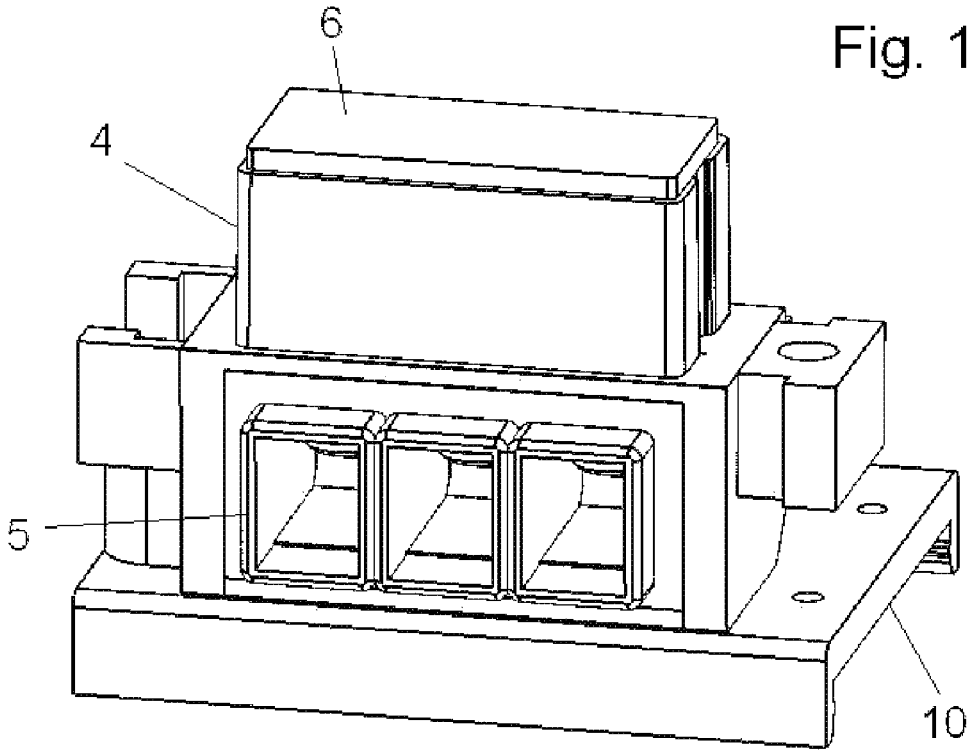

The simple, through and triple modular connectors of the present invention basically comprise:

An inner metallic conductor element formed by one or more in-contact metallic conductor parts (1) with a rectangular parallelepiped shape open at two opposite faces and which in its upper face has a threaded through drill (11) where the binding screw (2) is inserted to fasten the cables housed in the inner hole (12) of the metallic part. The metallic part (1) is casted, as represented in FIG. 11 or as it can be seen in FIG. 2, it is formed by folding from a flat bar (3) perforated at its ends (31) pressing it with a plate, die or press or else it is manufactured from a rectangular extruded profile. For the development of the inner conductor, a flat bar is used, which is drilled at its left and right ends (31), after being drilled it is formed, obtaining a rectangle with the two holes (11) one on top of the other.

A wraparound carcass made of a thermoplastic insulating material (4), using the same color of the conductor cable for this element. This carcass wraps around the metallic part(s), except at a frontal and rear faces in the through connectors through which the cables are inserted and at an upper elevated face through which the binding screw (2) is inserted, having as many holes (41) as metallic parts there are, these holes enabling the insertion of a tool to operate the corresponding binding screw (2).

The wraparound carcass (4) of the modular connectors has side male coupling (42) and female couplings or housing (43) which are perforated (44). These couplings (42-43) enable to group the connectors (4) in transversal direction.

The wraparound carcasses, when there is only one frontal face for cable rear face of said carcass (4). Said male (45) and female couplings (46) enable to group the different connectors in rear direction.

The two possible groupings mentioned before can be carried out jointly, to add new connections without modifying the already existing ones, making it possible to extend connections in a simplified manner. Besides the lateral and transversal interconnection, there exists the possibility of fixing in different bases through the holes (44) existing in the coupling (42-43).

An exterior wraparound frontal part (5) of the metallic part(s) (1), made of thermoplastic insulating material, which is equipped when there is only one frontal face for cable insertion, which is inserted containing said metallic part(s) (1) inside the wraparound carcass (4) for better insulation of the active parts.

Finally, the upper thermoplastic cover (6) is built into the face of the wraparound carcass (4) while remaining removable, by means of membranes (62) which are housed in the hole of the screw (41), or by means of stems (61) which are coupled in the corresponding holes (47) existing in said carcass (4), depending on whether the cover system is an extension or membrane system. This cover enables to signal the conductors connected to it.

The modular connectors without being castellated and with threaded rod screw of the present invention basically comprise:

A double-U-shaped metallic conductor part (7) made of a conductor material where the walls of each one of the "Us" are threaded (71) in such a way that binding screws (8) are inserted therein, formed by a threaded rod, without a head, unlike the preceding examples in which headed screws (2) are used.

Two U-shaped wraparound parts (4*a*-4*b*) of the conductor metallic part (7), also made of thermoplastic material, which can be built one into the other; one of them having lateral couplings exactly like the preceding ones (42-43). There exists the possibility of fixing in different bases through holes (44) in the lateral couplings.

An upper insulating cover (6), built into the upper wraparound part (4) but remaining removable, having holes to operate the binding screws (8), through two membranes (62).

With the lateral couplings different connectors can be grouped (through, three-holed, one-holed, double-U-shaped, etc.) as well as others corresponding to different sizes or cable sections, such as 1 $mm^2$, 1.5 $mm^2$, 2.5 $mm^2$, 4 $mm^2$, 6 $mm^2$, 10 $mm^2$, 16 $mm^2$ and upper, lower or even intermediate sections, as long as the size of their couplings coincides or an intermediate element thereof. It has been provided the possibility of interconnecting different sized connectors.

The wraparound carcasses, the insulating covers and the exterior frontal wraparound parts are manufactured using a suitable material to be able to fulfill the current standards for each place and time.

These modular connectors have been initially designed for conductor sections of 1 $mm^2$, 1.5 $mm^2$, 2.5 $mm^2$, 4 $mm^2$, 6 $mm^2$, 10 $mm^2$, 16 $mm^2$ and other standardized ones.

In order to facilitate the interconnection of the conductors where they are installed a thermoplastic insulator is included in the wraparound carcass, having a color identifying phase, neutral or ground.

As regards signalization of the electrical circuits, these components include a cover which can be signaled for the possible inscription of the circuit used. In this element, it will be possible to indicate a system of symbols or letters to identify the circuit, being it possible to use the existing ruling in each country and at each time. The following nomenclature for the identification of circuits, which is currently used in Spain, is included:

C1 LIGHTING
C2 GENERAL USE SOCKETS
C3 COOKER AND OVEN
C4 WASHING MACHINE, DISHWASHER, AND HEATER
C5 BATHROOM AND KITCHEN
C6 ADDITIONAL CIRCUIT TO C1 ABOVE 30 POINTS
C7 ADDITIONAL CIRCUIT TO C2 ABOVE 20 SOCKETS
C8 HEATING
C9 AIR CONDITIONING
C10 DRYER
C11 AUTOMATIZATION
C12 ADDITIONAL CIRCUIT TO C3 OR C4 ABOVE 6 SOCKETS

As regards the fastening of cables it must be highlighted that as it is a metallic conductor part, it offers greater fastening of the cables on the base, after the cables are pressed by the screws and it does not produce a curve nor does it produce any sliding thereof.

Figure 14:
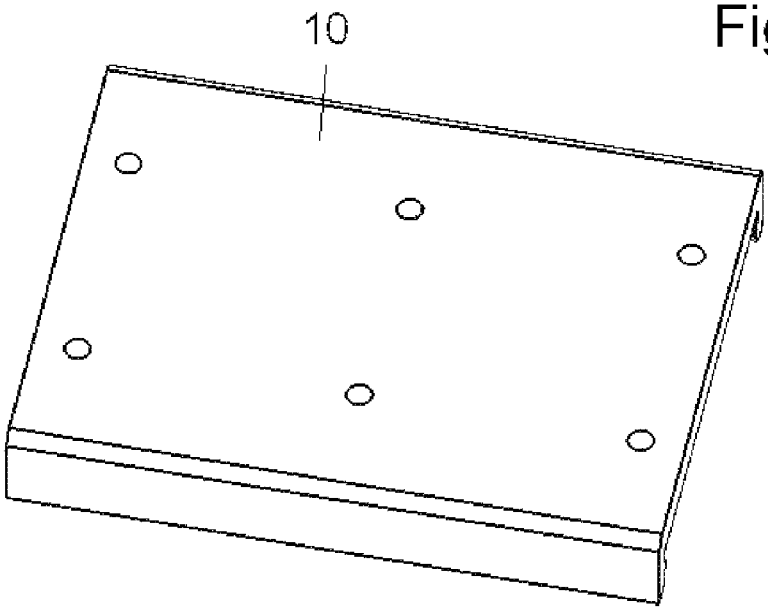
FIG. 14 shows a possible coupling of the electrical connector to a guide.

The fastening of the modular connectors is achieved by providing a hole in the couplings to be able to fix the elements to a jack box, terminal box, guiderail DIN (10) or any other system, forming a unique block (see FIG. 14).

The invention claimed is:

1. Modular connector for electrical connections, provided with circuit and conductor identification means, comprising:

an inner metallic conductor element formed by at least one metallic conductor part with a rectangular parallelepiped shape, open by two opposite faces and which in its upper face has a threaded through drill where a binding screw is inserted to fasten the cables housed in the inner hole of the metallic part;

a wraparound carcass made of a thermoplastic insulating material, which surrounds the metallic conductor part, except at a frontal and rear faces in the through connectors, through which the cables are inserted, and at an upper elevated face through which the binding screw is inserted, having as many holes as metallic parts there are, these holes enabling the insertion of a tool to operate said binding screw;

an exterior wraparound frontal part of the metallic part, made of thermoplastic insulating material, when there exists only one frontal face for cable insertion, and this wraparound frontal part is inserted containing said metallic part inside the wraparound carcass for insulation of the active parts; and upper thermoplastic cover which is built while remaining removable into the face of the wraparound carcass having a hole to operate the binding screw;

the wraparound carcass of said modular connector is laterally provided with male couplings and female couplings, and when there is only one frontal face for cable insertion, it is also provided with rear male and female couplings located at the rear face of said carcass, which enable to group several connectors in lateral and transversal direction, being it possible to carry out both groupings in a joint manner.

2. Modular connector according to claim 1, wherein the male and female couplings have holes which enable to group several connectors stacking them together.

3. Modular connector according to claim 1, wherein said upper thermoplastic cover, which is built into the face of the wraparound carcass while remaining removable, enables to be signaled in order to identify the electrical circuit to which the conductor belongs.

4. Modular connector according to claim 1, wherein the upper insulating cover which is thermoplastic and can be signaled is built into the upper wraparound part while remaining removable, by means of two membranes.

5. Modular connector according to claim 1, wherein the said wraparound carcass of thermoplastic insulating material is colored or marked, in order to identify any of the conductors: phase, neutral or safety ground connected to the modular connector to which it belongs.

6. Modular connector according to claim 1, wherein the metallic conductor part is formed by pressing with a press or plate from a flat bar, which is drilled at its ends, until a rectangular piece is obtained in which the holes coincide in order to establish two screwing surfaces of the corresponding binding screw of the corresponding conductor.

7. Modular connector according to claim 1, wherein the inner metallic conductor element is formed by a double-U-shaped metallic conductor part made of a conductor material where the inner walls are threaded in such a way that binding screws are inserted between them.

8. Modular connector according to claim 1, wherein the wraparound carcass has two double-U-shaped parts also made of thermoplastic insulating material, built into one another, and one of them is provided with side couplings for the lateral grouping of two modular connectors, as well as holes which enable the fixing in different bases through them.

* * * * *

UNITED STATES PATENT AND TRADEMARK OFFICE

CERTIFICATE OF CORRECTION

PATENT NO. : 8,210,882 B2
APPLICATION NO. : 12/674274
DATED : July 3, 2012
INVENTOR(S) : Tomás Gilabert et al.

It is certified that error appears in the above-identified patent and that said Letters Patent is hereby corrected as shown below:

In the Specifications:

Col. 3, Line 21: "for cable rear face of said carcass (4)" should read --for cable insertion, are provided with male (45) and female couplings (46) located at the rear face of said carcass (4)--

Signed and Sealed this
Fourth Day of June, 2013

Teresa Stanek Rea
*Acting Director of the United States Patent and Trademark Office*